US012295415B2

(12) United States Patent
Silvestrini et al.

(10) Patent No.: US 12,295,415 B2
(45) Date of Patent: May 13, 2025

(54) CARTRIDGE FOR AN AEROSOL-GENERATING SYSTEM

(71) Applicant: Altria Client Services LLC, Richmond, VA (US)

(72) Inventors: Patrick Charles Silvestrini, Neuchatel (CH); Ihar Nikolaevich Zinovik, Peseux (CH); Noori Moyad Brifcani, Neuchatel (CH); Guillaume Frederick, Les-Geneveys-sur-Coffrane (CH)

(73) Assignee: Altria Client Services LLC, Richmond, VA (US)

( * ) Notice: Subject to any disclaimer, the term of this patent is extended or adjusted under 35 U.S.C. 154(b) by 660 days.

(21) Appl. No.: 16/184,322

(22) Filed: Nov. 8, 2018

(65) Prior Publication Data

US 2019/0082739 A1 Mar. 21, 2019

Related U.S. Application Data

(63) Continuation of application No. PCT/EP2018/071551, filed on Aug. 8, 2018.

(30) Foreign Application Priority Data

Sep. 18, 2017 (EP) ..... 17191636.4

(51) Int. Cl.
*A24F 40/42* (2020.01)
*A24B 15/167* (2020.01)
(Continued)

(52) U.S. Cl.
CPC ..... *A24F 40/42* (2020.01); *A24B 15/167* (2016.11); *A24F 40/485* (2020.01); *A24F 40/10* (2020.01); *A24F 40/46* (2020.01)

(58) Field of Classification Search
CPC ..... A24F 40/49; A24F 40/10; A24F 40/42; A24F 40/46
See application file for complete search history.

(56) References Cited

U.S. PATENT DOCUMENTS 5,167,242 A 12/1992 Turner et al.
6,790,496 B1 9/2004 Levander et al.
(Continued)

FOREIGN PATENT DOCUMENTS

AR 099324 A1 7/2016
CN 103462224 A 12/2013
(Continued)

OTHER PUBLICATIONS

International Search Report and Written Opinion for corresponding European Application No. PCT/EP2018/071551 dated Oct. 29, 2018, pp. 1-9.
(Continued)

*Primary Examiner* — Russell E Sparks
(74) *Attorney, Agent, or Firm* — Harness, Dickey & Pierce P.L.C.

(57) ABSTRACT

A cartridge for an aerosol-generating system, the cartridge including a housing, a storage compartment, an air flow passage, a fluid permeable aerosol-generating element, and a removable seal. The housing having a mouth end opening and an air inlet. The storage compartment is within the housing. The storage compartment is configured to contain a liquid aerosol-forming substrate. The air flow passage extending from the air inlet to the mouth end opening. The fluid permeable aerosol-generating element is within the housing. The fluid permeable aerosol-generating element has a first surface and a second surface opposing the first surface, the second surface being in fluid communication with the storage compartment. The removable seal has a seal portion and a tab portion, the seal portion in the air flow
(Continued)

passage over the first surface of the fluid permeable aerosol-generating element, and the tab portion extending outwardly from the housing through the air inlet.

19 Claims, 7 Drawing Sheets

(51) Int. Cl.
*A24F 40/10* (2020.01)
*A24F 40/46* (2020.01)
*A24F 40/485* (2020.01)

(56) References Cited

U.S. PATENT DOCUMENTS

| | | | | |
|---|---|---|---|---|
| 8,991,402 | B2 | 3/2015 | Bowen et al. | |
| 9,351,522 | B2 | 5/2016 | Safari | |
| 9,420,831 | B2 | 8/2016 | Liu | |
| 9,439,455 | B2 | 9/2016 | Alarcon et al. | |
| 9,936,731 | B2 | 4/2018 | Hopps | |
| 9,943,114 | B2 | 4/2018 | Batista | |
| 9,986,765 | B2 | 6/2018 | Batista | |
| 10,080,387 | B2 | 9/2018 | Phillips et al. | |
| 10,149,497 | B2 * | 12/2018 | Memari | B65B 37/06 |
| 10,149,498 | B2 | 12/2018 | Batista et al. | |
| 10,159,284 | B2 | 12/2018 | Dickens | |
| 10,231,486 | B2 * | 3/2019 | Bowen | A63F 9/001 |
| 10,602,780 | B2 | 3/2020 | Chen | |
| 10,687,552 | B2 | 6/2020 | Zinovik et al. | |
| 10,869,505 | B2 * | 12/2020 | Borkovec | A24F 40/30 |
| 10,905,161 | B2 * | 2/2021 | Chen | A24F 40/485 |
| 11,134,716 | B2 * | 10/2021 | Dick | A24F 40/42 |
| 2011/0226236 | A1 | 9/2011 | Buchberger | |
| 2013/0074857 | A1 | 3/2013 | Buchberger | |
| 2013/0192623 | A1 | 8/2013 | Tucker et al. | |
| 2013/0228191 | A1 | 9/2013 | Newton | |
| 2013/0319407 | A1 | 12/2013 | Liu | |
| 2013/0327327 | A1 * | 12/2013 | Edwards | A61M 15/0016 128/203.11 |
| 2014/0000638 | A1 | 1/2014 | Sebastian et al. | |
| 2015/0040929 | A1 | 2/2015 | Hon | |
| 2015/0090279 | A1 | 4/2015 | Chen | |
| 2015/0163859 | A1 | 6/2015 | Schneider et al. | |
| 2015/0181943 | A1 | 7/2015 | Li et al. | |
| 2015/0272217 | A1 | 10/2015 | Chen | |
| 2016/0007654 | A1 | 1/2016 | Zhu | |
| 2016/0073692 | A1 | 3/2016 | Alarcon et al. | |
| 2016/0128386 | A1 | 5/2016 | Chen | |
| 2016/0138795 | A1 | 5/2016 | Meinhart et al. | |
| 2016/0262454 | A1 | 9/2016 | Sears et al. | |
| 2016/0338410 | A1 | 11/2016 | Batista et al. | |
| 2016/0345630 | A1 | 12/2016 | Mironov et al. | |
| 2016/0374399 | A1 | 12/2016 | Monsees et al. | |
| 2017/0027226 | A1 | 2/2017 | Mironov et al. | |
| 2017/0181472 | A1 | 6/2017 | Batista et al. | |
| 2017/0251718 | A1 * | 9/2017 | Armoush | H05B 6/105 |
| 2017/0340014 | A1 | 11/2017 | Batista et al. | |
| 2018/0279679 | A1 | 10/2018 | Mcadam et al. | |
| 2019/0045837 | A1 | 2/2019 | Spencer | |
| 2019/0335819 | A1 | 11/2019 | Watanabe | |

FOREIGN PATENT DOCUMENTS

| | | | |
|---|---|---|---|
| CN | 203341007 | U | 12/2013 |
| CN | 203341008 | U | 12/2013 |
| CN | 103932401 | A | 7/2014 |
| CN | 203969207 | * | 12/2014 |
| CN | 203969207 | U | 12/2014 |
| CN | 104540406 | A | 4/2015 |
| CN | 204617067 | U | 9/2015 |
| CN | 105559151 | A | 5/2016 |
| CN | 105722416 | A | 6/2016 |
| CN | 105876873 | A | 8/2016 |
| CN | 205512340 | U | 8/2016 |
| CN | 105939625 | A | 9/2016 |
| CN | 106455713 | A | 2/2017 |
| CN | 206197017 | U | 5/2017 |
| CN | 106998813 | A | 8/2017 |
| CN | 106998816 | A | 8/2017 |
| CN | 107105776 | A | 8/2017 |
| CN | 108289505 | A | 7/2018 |
| DE | 102014114133 | A1 | 3/2016 |
| DE | 202016100917 | U1 | 3/2016 |
| EP | 2460424 | A1 | 6/2012 |
| EP | 2888963 | A1 | 7/2015 |
| EP | 3053459 | A2 | 8/2016 |
| EP | 3158882 | A2 | 4/2017 |
| EP | 3684203 | B1 | 2/2023 |
| JP | 2014/511175 | A | 5/2014 |
| JP | 5815559 | | 11/2015 |
| JP | 2017-506076 | A | 3/2017 |
| JP | 2017/519492 | A | 7/2017 |
| JP | 2017/522021 | A | 8/2017 |
| JP | 2017/522872 | A | 8/2017 |
| JP | 2018-504132 | A | 2/2018 |
| KR | 20160102293 | A | 8/2016 |
| KR | 2016/0119773 | A | 10/2016 |
| KR | 20160119777 | A | 10/2016 |
| RU | 2489948 | C2 | 8/2013 |
| RU | 2597531 | C2 | 9/2016 |
| RU | 2608289 | C2 | 1/2017 |
| RU | 2657215 | C2 | 6/2018 |
| TW | 201534229 | A | 9/2015 |
| TW | 201620405 | A | 6/2016 |
| UA | 67598 | U | 2/2012 |
| UA | 116828 | C2 | 5/2018 |
| WO | WO-2014/102092 | A1 | 7/2014 |
| WO | WO-2014/110119 | A1 | 7/2014 |
| WO | WO-2015/043132 | A1 | 4/2015 |
| WO | WO-2015/100361 | A1 | 7/2015 |
| WO | WO-2015/114325 | | 8/2015 |
| WO | WO-2015/117700 | A1 | 8/2015 |
| WO | WO-2015/117702 | A1 | 8/2015 |
| WO | WO-2015/117704 | A1 | 8/2015 |
| WO | WO-2015/117705 | A2 | 8/2015 |
| WO | WO-2015/179292 | A1 | 11/2015 |
| WO | WO-2015/189623 | A1 | 12/2015 |
| WO | WO-2016/005530 | A1 | 1/2016 |
| WO | WO-2016/041206 | A1 | 3/2016 |
| WO | WO-2016/075748 | A1 | 5/2016 |
| WO | WO-2016/092261 | A1 | 6/2016 |
| WO | WO-2016/096497 | A1 | 6/2016 |
| WO | WO-2016/096728 | A1 | 6/2016 |
| WO | WO-2016/101141 | A1 | 6/2016 |
| WO | WO-2016/145612 | A1 | 9/2016 |
| WO | WO-2016/156103 | A1 | 10/2016 |
| WO | WO-2016/172023 | A1 | 10/2016 |
| WO | WO-2016/172448 | A1 | 10/2016 |
| WO | WO-2016156413 | A1 * | 10/2016 | A24F 40/42 |
| WO | WO-2016/198417 | A1 | 12/2016 |
| WO | WO-2017/019402 | A2 | 2/2017 |
| WO | WO-2017/042081 | A1 | 3/2017 |
| WO | WO-2017064051 | A1 * | 4/2017 | A24B 15/167 |
| WO | WO-2018/153608 | A1 | 8/2018 |
| WO | WO-2018/153732 | A1 | 8/2018 |

OTHER PUBLICATIONS

International Preliminary Report on Patentability issued Apr. 2, 2020 in International Application No. PCT/EP2018/071551, pp. 1-10.

Official Notification dated Nov. 11, 2021, issued in corresponding Russian Patent Application No. 2020113626/03.

Russian Office Action and Search Report dated Apr. 8, 2022, issued in corresponding Russian Patent Application No. 2020113626.

Extended European Search Report #17157957.6 dated Dec. 20, 2017.

Extended European Search Report #17157960.0 dated Sep. 21, 2017.

International Search Report and Written Opinion issued Apr. 19, 2018 in related PCT Application No. PCT/EP2018/053579.

(56) References Cited

OTHER PUBLICATIONS

International Search Report and Written Opinion issued May 2, 2018 in related PCT Application No. PCT/EP2018/051730.
International Preliminary Report on Patentability dated Sep. 6, 2019, issued in corresponding International Application No. PCT/EP2018/053579.
Office Action dated Jul. 21, 2020, issued in corresponding U.S. Appl. No. 15/903,612.
Office Action dated Aug. 17, 2020, issued in corresponding U.S. Appl. No. 15/903,659.
Office Action dated Nov. 10, 2020, issued in corresponding U.S. Appl. No. 15/903,612.
Advisory Action dated Mar. 29, 2021, issued in corresponding U.S. Appl. No. 15/903,659.
Office Action dated Mar. 22, 2021, issued in corresponding Taiwanese Patent Application No. 107105796.
Office Action dated Jun. 8, 2021, issued in corresponding Indian Patent Application No. 201917029535.
Office Action dated May 17, 2021, issued in corresponding Indonesian Patent Application No. PID201907026.
Office Action dated May 25, 2021, issued in corresponding Taiwanese Patent Application No. 107105602.
Office Action dated Jun. 24, 2021, issued in corresponding U.S. Appl. No. 15/903,612.
Machine translation of TW201534229A (translation date: Jun. 16, 2021).
Russian Decision to Grant and Search Report dated May 26, 2021, issued in corresponding Russian Patent Application No. 2019126654.
Russian Decision to Grant and Search Report dated Jul. 5, 2021, issued in corresponding Russian Patent Application No. 2019129609.
Examination Report dated Jul. 8, 2021, issued in corresponding Indian Application No. 201917025257.
Allowance Decision dated Jul. 29, 2021, issued in corresponding Taiwanese Application No. 107105796.
Office Action dated Aug. 26, 2021, issued in corresponding U.S. Appl. No. 15/903,659.
Ukrainian Decision to Grant dated Aug. 17, 2021, issued in corresponding Ukrainian Patent Application No. a201907116.
Singapore Decision to Grant dated Sep. 29, 2021, issued in corresponding Singapore Patent Application No. 11201907696Q.
Allowance Decision dated Nov. 18, 2021, issued in corresponding Taiwanese Application No. 107105602.
Allowance decision dated Oct. 22, 2021, issued in corresponding Indonesian Patent Application No. PID201907026.
Office Action dated Dec. 6, 2021, issued in corresponding U.S. Appl. No. 15/903,659.
Office Action dated Nov. 1, 2021, issued in corresponding Chinese Patent Application No. 201880009372.7.
Office Action dated Jan. 3, 2022, issued in corresponding U.S. Appl. No. 15/903,612.
Office Action dated Dec. 3, 2021 issued in corresponding Chinese Patent Application No. 201880009641.
Notice of Allowance dated Mar. 23, 2022, issued in corresponding U.S. Appl. No. 15/903,659.
Office Action dated Dec. 7, 2021 issued in corresponding Argentine Patent Application No. 20180100438.
Appeal Notice dated Nov. 30, 2021, issued in corresponding Russian Patent No. RU-2,754,483-C2.
Standard GOST 2715-75.
International Standard GOST 25346-2013 (ISO 286-1:2010).
Standard GOST 3.1109-82.
Physical Encyclopedia, ed. A.M. Prokhorov, vol. 1, 1994, pp. 119, 614-615.
Gavrilov N.V., Kamenetsky A.S., ZhTF, 2007, vol. 77, issue 3, pp. 12-16.
Notice of Allowance dated Apr. 7, 2022, issued in corresponding U.S. Appl. No. 15/903,659.
Getmanov V.N. PMTF, 1991, No. 1, p. 3-8.
Office Action dated Feb. 21, 2022 issued in corresponding Japanese Patent Application No. 2019-546182.
Notice of Allowance dated Apr. 20, 2022, issued in corresponding U.S. Appl. No. 15/903,659.
Notice of Allowance dated May 3, 2022, issued in corresponding European Patent Application No. 18 705 140.4.
Notice of Allowance dated Mar. 24, 2022, issued in corresponding Israeli Patent Application No. 268334.
Notice of Deficiencies dated Mar. 20, 2022, issued in corresponding Israeli Patent Application No. 268332.
Office Action dated Feb. 28, 2022 issued in corresponding Japanese Patent Application No. 2019-545349.
Office Action dated May 16, 2022, issued in corresponding Chinese Patent Application No. 201880009372.7.
Decision to Grant dated Jul. 4, 2022 issued in corresponding Japanese Patent Application No. 2019-545349.
Notice of Allowance dated Jul. 22, 2022 issued in corresponding Chinese Patent Application No. 201880009641.
Notice of Allowance dated Jul. 29, 2022, issued in corresponding U.S. Appl. No. 15/903,612.
Russian Decision to Grant dated Jul. 6, 2022, issued in corresponding Russian Patent Application No. 2022103042.
Office Action dated Aug. 2, 2022, issued in corresponding Brazilian Patent Application No. 1120190149759.
Additional Arguments for Appeal dated Feb. 10, 2022, issued in corresponding Russian Patent No. RU-2,754,483-C2.
Annex to Additional Arguments for Appeal dated Mar. 4, 2022, issued in corresponding Russian Patent No. RU-2,754,483-C2.
Chemical Resistance Chart by Burkert, 2018 https://vwww.burkert.com/en/content/download/9318/334992/iile/Chemical-Resistance-Chart.pdf?id=48.
Chemical Compatibility Chart by IDEX, 2022, https://www.idex-hs.com/literature-tools/educational-materials/chemical-compatibility/_.
Aditya Ramgobin et al., 'A Case Study of Polyether Ether Ketone (I): Investigating the Thermal and Fire Behavior of a High-Performance Material' *Polymers*, vol. 12, No. 1789, Aug. 2020.
Chemical Compatibility Table by Colder, Aug. 2011, https://www.usplastic.com/catalog/files/charts/Colder%20CC.pdf.
Chemical Compatibility Table by Colder, Jan. 2010, https://www.tom-parker.co.uk/upload/files/literature/CPC_Chemical_Compatibility_Chart_(261KB).pdf.
Excerpt from PEEK polymer chemical compatibility table by polymer manufacturer Victrex: Chemical Resistance; Victrex Peek Polymers, 2016, https://www.victrex.com/en/technical-guides.
Excerpt from technical guides in respect of PEEK polymer properties by polymer manufacturer Victrex: Safety Data Sheet, Nov. 2021, https://www.victrex.com/en/technical-guides.
Excerpt from Material Safety Data Sheet for PEEK polymer by polymer manufacturer Victrex: Technical Guide, 2016, https://www.victrex.com/en/msds .
Michael O'Conner, 'Philip Morris delayed e-vapor launch as vaping fears spread' S&P Global, Feb. 2020, https://www.spglobal.com/marketintelligence/en/news-insights/latest-news-headlines/philip-morris-delayed-e-vapor-launch-as-vaping-fears-spread-56987277.
Ukrainian Decision to Grant dated Aug. 9, 2022, issued in corresponding Ukrainian Patent Application No. a 2019 07117.
Notice of Allowance dated Aug. 30, 2022, issued in corresponding U.S. Appl. No. 15/903,612.
Notice of Allowance dated Sep. 14, 2022, issued in corresponding U.S. Appl. No. 15/903,659.
Notice of Allowance dated Jul. 25, 2022, issued in corresponding Israeli Patent Application No. 268332.
Office Action dated Sep. 6, 2022, issued in corresponding Brazilian Patent Application No. 1120190143009.
Office Action dated Jul. 21, 2022, issued in corresponding Brazilian Patent Application No. 112020003506-8.
Russian Decision to Grant dated Jul. 6, 2022, issued in corresponding Russian Patent Application No. 2020113626.
Examination Report dated Nov. 10, 2022, issued in corresponding Malaysian Patent Application No. PI2019004849.
Office Action issued on Oct. 11, 2022 in corresponding Japanese Application No. 2020-515922.
Office Action dated Dec. 13, 2022 issued in corresponding Korean Patent Application No. 10-2019-7022821.

(56) References Cited

OTHER PUBLICATIONS

Notice of Allowance dated Oct. 21, 2022 issued in corresponding Chinese Patent Application No. 201880009372.7.
Search Report dated Oct. 25, 2022, issued in corresponding Malaysian Patent Application No. PI2019003605.
Decision of Grant issued on Nov. 16, 2022 in corresponding to Japanese Application No. 2019-546182.
Examination Report dated Nov. 17, 2022, issued in corresponding Australian Application No. 2018224736.
Examination Report dated Nov. 21, 2022, issued in corresponding Australian Application No. 2018226112.
Notice of Allowance dated Nov. 10, 2022, issued in corresponding U.S. Appl. No. 15/903,659.
Notice of Allowance dated Nov. 22, 2022, issued in corresponding U.S. Appl. No. 15/903,612.
Office Action dated Sep. 7, 2022, issued in corresponding Israeli Patent Application No. 272286.
Notice of Acceptance dated Mar. 27, 2023, issued in corresponding Australian Application No. 2018226112.
Office Action dated Feb. 15, 2023 issued in corresponding Korean Patent Application No. 10-2019-7020165.
Office Action dated Feb. 23, 2023 issued in corresponding Chinese Patent Application No. 201880055055.9.
Notice of Allowance dated Jan. 30, 2023 issued in corresponding Israeli Patent Application No. 272286.
Notice of Allowance dated Mar. 6, 2023 issued in corresponding Japanese Patent Application No. 2020-515922.
Office Action dated May 2, 2023 issued in corresponding Ukrainian Patent Application No. a 2020 01404.
Brazilian Office Action, dated Aug. 1, 2023, issued in corresponding Brazilian Patent Application No. BR112019014300-9.
Malaysian Office Action, dated Aug. 30, 2023, issued in corresponding Malaysian Patent Application No. PI2019004849.
Notice of Opposition dated Jul. 17, 2023, issued in corresponding European Patent Application No. 18705140.4 / U.S. Pat. No. 3585190.
Notice of Allowance dated Aug. 14, 2023, issued in corresponding Korean Patent Application No. 10-2019-7020165.
Notice of Allowance for Korean Application No. 10-2019-7022821 dated Jun. 16, 2023.
European Notice of Opposition, dated Nov. 7, 2023, issued in related European Patent Application No. 18752151.3.
Office Action dated Jul. 12, 2023 issued in corresponding Ukrainian Patent Application No. a 2020 01404.
Indian Office Action, dated Nov. 9, 2023, issued in corresponding Indian Patent Application No. 201917025257.
Brazilian Office Action, dated Dec. 4, 2023, issued in Brazilian Patent Application No. BR112019014300-9.
Malaysian Office Action, dated Jan. 24, 2024, issued in Malaysian Patent Application No. PI2020000389.
Mexican Notice of Allowance, dated Jan. 23, 2024, issued in Mexican Patent Application No. MX/a/2019/009433.
European Notice of Allowance, dated Feb. 1, 2024, issued in European Patent Application No. 22215573.1.
Indian Office Action, dated Jan. 29, 2024, issued in Indian Patent Application No. 201917029535.
Japanese Notice of Allowance, dated Feb. 8, 2024, issued in Japanese Patent Application No. 2023-001599.
Malaysian Notice of Allowance, dated Feb. 9, 2024, issued in Malaysian Patent Application No. PI2019004849.
Brazilian Office Action, dated Apr. 2, 2024, issued in Brazilian Patent Application No. BR112019014300-9.
Philippines Office Action, dated May 15, 2024, issued in Philippines Patent Application No. 1-2019-501493.
Philippines Office Action, dated May 15, 2024, issued in Philippines Patent Application No. 1-2019-501531.
Mexican Office Action, dated Feb. 22, 2024, issued in Mexican Patent Application No. MX/a/2020/002695.
Final Office Action, dated Jun. 4, 2024, issued in U.S. Appl. No. 18/182,466.
Canadian Office Action, dated May 24, 2024, issued in Canadian Patent Application No. 3,049,937.
Canadian Office Action, dated May 21, 2024, issued in Canadian Patent Applicaiton No. 3,047,676.
Office Action, dated Sep. 20, 2024, issued in U.S. Appl. No. 18/166,761.
European Opposition Letter, dated Sep. 12, 2024, issued in European Patent Application No. 187051404.
Philippines Office Action, dated Sep. 6, 2024, issued in Philippines Patent Application No. 1-2019-501531.
Brazilian Office Action, dated Sep. 3, 2024, issued in Brazilian Patent Application No. 1120190143009.
Philippines Office Action, dated Sep. 6, 2024, issued in Philippines Patent Application No. 1-2019-501493.
Philippines Office Action, dated Nov. 15, 2024, issued in Philippines Patent Application No. 1-2020-500083.
Extended European Search Report, dated Nov. 4, 2024, issued in European Patent Application No. 24179275.3.
European Decision Rejecting the Opposition, dated Dec. 6, 2024, issued in European Patent Application No. 18705140.4.
Notice of Allowance, dated Jan. 2, 2025, issued in U.S. Appl. No. 18/166,761.
Notice of Allowance issued Jan. 16, 2025 in U.S. Appl. No. 18/182,466.
Philippines Office Action issued Jan. 31, 2025 in Philippines Patent Application No. 1-2020-500083.

* cited by examiner

CARTRIDGE FOR AN AEROSOL-GENERATING SYSTEM

This application is a continuation of, and claims priority to, international application number PCT/EP2018/071551, filed on Aug. 8, 2018, which claims priority to European patent application number 17191636.4, filed Sep. 18, 2017, the entire contents of each of which are incorporated herein by reference.

BACKGROUND

Field

The example embodiments disclosed herein relate to a cartridge for an aerosol-generating system (also called a "vapour-generating system") that is configured to heat a liquid aerosol-forming substrate (also called "pre-vapor formulation") to generate an aerosol (also called a "vapour"). In particular, the example embodiments relate to handheld aerosol-generating systems such as electronically operated smoking systems.

Description of Related Art

In many handheld aerosol-generating systems, an electrical heater is used for vaporising a liquid aerosol-forming substrate to generate an aerosol. The liquid substrate is usually contained in a replaceable cartridge, having a mouth end through which the generated aerosol is discharged and a connection end opposite the mouth end. In some devices, the electrical heater is a fluid permeable mesh provided at the connection end for connecting to a control unit containing control circuitry and a power supply. The liquid is held in a storage compartment between the heater element and the mouth end of the cartridge. Such a replaceable cartridge allows replacement of the consumed liquid substrate without discarding other parts of the system such as the power supply and allows for simple connection of the heater to the power supply.

However, due to complex designs, many prior art cartridges are difficult to mass produce economically by conventional techniques such as injection moulding.

SUMMARY

At least one example embodiment is directed toward a cartridge.

In one embodiment, the cartridge for an aerosol-generating system includes a housing having a mouth end opening and an air inlet, a storage compartment within the housing, the storage compartment configured to contain a liquid aerosol-forming substrate, an air flow passage extending from the air inlet to the mouth end opening, a fluid permeable aerosol-generating element within the housing, the fluid permeable aerosol-generating element having a first surface and a second surface opposing the first surface, the second surface being in fluid communication with the storage compartment, and a removable seal having a seal portion and a tab portion in connection with the seal portion, the seal portion in the air flow passage over the first surface of the fluid permeable aerosol-generating element, and the tab portion extending outwardly from the housing through the air inlet.

In one embodiment, removal of the seal portion from over the first surface by applying a pulling force on the tab portion, places the first surface in fluid communication with the air flow passage.

In one embodiment, the removable seal comprises a retainer configured to retain the removable seal over the air flow passage until the pulling force is applied on the tab portion.

In one embodiment, the removable seal is removable from the air flow passage through the air inlet.

In one embodiment, the tab portion is flexible and is configured to bend at the air inlet so to conform with an external profile of the housing.

In one embodiment, the seal portion is arranged to provide a hermetic seal between the fluid permeable aerosol-generating element and the air flow passage.

In one embodiment, the storage compartment comprises a first compartment and a second compartment, the first compartment and the second compartment being connected by a connector configured to allow liquid to pass from the first compartment to the second compartment through a liquid passage of the connector and the first surface faces the first compartment and the second surface faces the second compartment, with the second surface in fluid communication with the second compartment, so that liquid aerosol-forming substrate in the first compartment can reach the fluid permeable aerosol-generating element only through the second compartment.

In one embodiment, the connector and the first surface of the fluid permeable aerosol-generating element defines at least part of the air flow passage.

In one embodiment, the airflow passage extends from the air inlet to the mouth end opening, and between the first compartment and the second compartment.

In one embodiment, the first compartment is positioned between the fluid permeable aerosol-generating element and the mouth end opening.

In one embodiment, the connector is connected to the first compartment and/or the second compartment by an interference fit.

In one embodiment, the fluid permeable aerosol-generating element is a heater element.

In one embodiment, the cartridge of comprises a heater assembly, the heater assembly including the heater element and electrical contact portions electrically connected to the heater element, the electrical contact portions being exposed through a connection end of the cartridge.

In one embodiment, the storage compartment includes a heater mount, the heater mount being moulded over the heater assembly.

In one embodiment, the cartridge for an aerosol-generating system, includes a housing having a mouth end opening and an air inlet, a storage compartment within the housing, the storage compartment configured to contain a liquid aerosol-forming substrate; the storage compartment having a first compartment and a second compartment connected by a connector, the connector configured to allow liquid in the first compartment can pass to the second compartment through a liquid passage in said connector, an air flow passage extending from the air inlet to the mouth end opening, the air flow passage passing between the first compartment and the second compartment, and a fluid permeable aerosol-generating element having a first surface and a second surface opposite to the first surface, the first surface of the fluid permeable aerosol-generating element facing the first compartment, the second surface facing the second compartment, the second surface in fluid communication with the second compartment so that liquid aerosol-forming substrate in the first compartment can reach the fluid permeable aerosol-generating element only through the second compartment, the first surface and the connector forming part of the air flow passage, wherein the liquid aerosol-forming substrate in the first compartment can reach the fluid permeable aerosol-generating element only through the connector and the second compartment.

Some example embodiments relate to an aerosol-generating system.

In one embodiment, the aerosol-generating system comprises, the above mentioned embodiments of the cartridge and a control body connected to the cartridge, the control body configured to control a supply of electrical power to the fluid permeable aerosol-generating element.

In one embodiment, the aerosol-generating system includes a housing having a mouth end opening and an air inlet, a storage compartment within the housing, the storage compartment configured to contain a liquid aerosol-forming substrate, an air flow passage extending from the air inlet to the mouth end opening, a fluid permeable aerosol-generating element within the housing and having a first surface and a second surface opposing the first surface, the second surface being in fluid communication with the storage compartment, a removable seal having a seal portion and a tab portion in connection with the seal portion, the seal portion in the air flow passage over the first surface of the fluid permeable aerosol-generating element, the tab portion extending outwardly from the housing through the air inlet, and a control body configured to control a supply of electrical power to the fluid permeable aerosol-generating element.

BRIEF DESCRIPTION OF THE DRAWINGS

Example embodiments will now be described, by way of example only, with reference to the accompanying drawings, in which.

DETAILED DESCRIPTION OF THE DRAWINGS

Figure 1A:
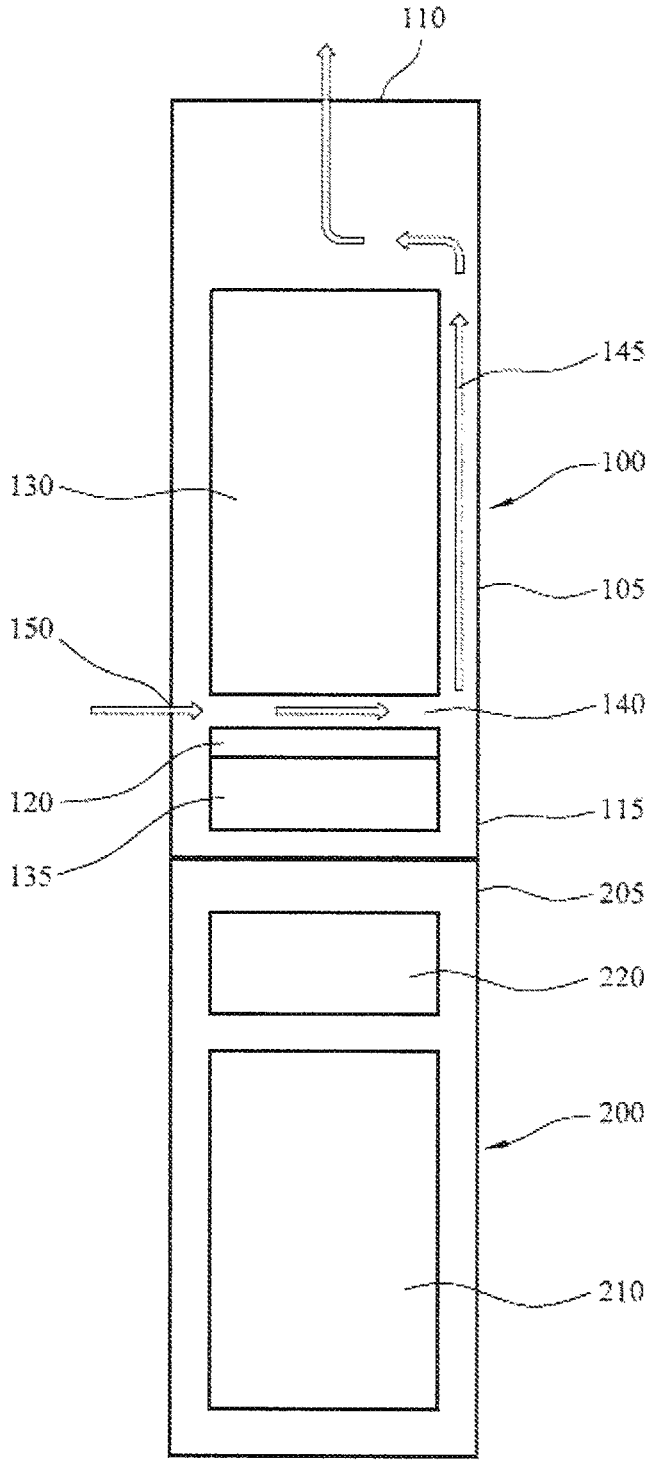
FIG. 1*a* is a schematic illustration of an aerosol-generating system according to an example embodiment.

In an example embodiment there is provided a cartridge for an aerosol-generating system (also called a "vapor-generating system"), the cartridge comprising: a housing having a mouth end opening and an air inlet; a storage compartment within the housing and configured to contain a liquid aerosol-forming substrate (also called a "pre-vapor formulation"); an air flow passage extending from the air inlet to the mouth end opening; a fluid permeable aerosol-generating element (also called a "vapor-generating element") within the housing, having a first surface and a second surface opposing the first surface, the second surface being in fluid communication with the storage compartment; and a removable seal having a seal portion and a tab portion in connection with the seal portion, the seal portion positioned in the air flow passage over the first surface of the aerosol-generating element, and the tab portion extend outwardly from the housing through the air inlet.

The aerosol-generating element may be a heater element. The aerosol-generating element may be a mesh heater. The mesh heater may allow liquid aerosol-forming substrate stored in the storage compartment to pass through interstices in the mesh heater from its second surface to its first surface. Alternatively, the aerosol-generating element may be a vibrating element.

The removable seal is positioned in the air flow passage over the first surface of the aerosol-generating element during transportation and storage of the cartridge. Storage herein can be referred to as long term storage, e.g. storage in warehouses and places of sale and storage before first operation. The seal portion serves to cut off fluid communication between the aerosol-generating element and the air flow passage. This may be achieved by sealing the first surface directly, or by sealing off a section of housing adjacent to the first surface, e.g. interior walls of the housing. By sealing off the fluid communication between the first surface and the air flow passage, leakage and evaporation of liquid aerosol-forming substrate can be eliminated or at least reduced during transportation and storage.

The tab portion forms a part of the removable seal that is accessible. That is, when the seal portion of the removable seal is positioned in the air flow passage over the first surface, the tab portion extends beyond the exterior surface of the housing.

Extracting the seal portion through the air inlet, allows a shorter removable seal to be used.

Optionally, when positioned in the air flow passage, the seal portion forms an air-tight seal in the air flow passage. For example, the seal portion may extend across the air flow passage to form air-tight blockage, in order to prevent air flow in the air flow passage. This prevents dust and dirt from collecting within the air flow passage. Optionally, the seal portion extends from the mouth end opening to the air inlet. Optionally, the seal portion is configured to match the dimension of the air flow passage so to completely block up the air flow passage.

Optionally, removal of the seal portion from over the first surface by applying a pulling force on the tab portion, places the first surface in fluid communication with the air flow passage. Prior to first operation, the tab portion of the removable seal may be removed from the cartridge by pulling on the tab so to extract the removable seal from the air flow passage. The removal of the removable seal establishes fluid communication between the aerosol-generating element and the air flow passage. This allows generated aerosol (also called "generated vapor") to be discharged through the mouth end opening. The surface of the tab portion may have indentations and/or protrusions for improved grip on the tab portion. Advantageously, the surface area of the tab portion is sufficiently large to be easily gripped by fingers.

Optionally, the removable seal is reusable. A removed seal portion may be reinserted into the air flow passage to be positioned in the air flow passage over the first surface of the aerosol-generating element. This permits the cartridge to be resealed for further storage and transportation subsequent to operation.

Optionally, the removable seal comprises a retainer or a configured to retain the removable seal over the first surface of the aerosol-generating element until the pulling force is applied on the tab portion. In other words the retainer is configured to retain the removable seal over the first surface of the aerosol generating element until the pulling force is applied on the tab portion. The retainer may be any retainer known to the person skilled in the art, for example the retainer may be a mechanical retainer such as a spring clip or a latch that engages with the first surface and/or the housing, or it can be achieved by a bonding technique such as glued sealing, heat sealing or induction heat sealing.

Optionally, the tab portion extends outwardly from the housing through the mouth end opening. This allows the mouth end opening to be closed off by the tab portion, and may serve as a reminder to remove the removable seal prior to operation.

Optionally, a safety mechanism is provided to prevent the aerosol-generating element from operating before the seal portion is removed from the air flow passage. Such a safety mechanism may be any mechanism known to the person skilled in the art, for example safety mechanisms such as removable connector seals and interlocks that are formed integrally with the seal portion, or it can be more complicated electronic sensors such as air flow sensors or pressure activated switches in communication with the air flow passage. The safety mechanism serves to prevent unintentional heater operation, whilst the seal portion is positioned over the heater element.

Optionally, the removable seal may be produced from thermoplastic elastomer (TPE), styrene ethylene butylene styrene (SEBS), polyethersulfone (PESU), rubber, silicone, or any suitable material known to the person skilled in the art. The tab portion and the seal portion maybe moulded or extruded from a single piece of material, or they may be manufactured from different materials for different purposes. For example, the seal portion may be made of a more elastic material than the tab portion so as to achieve a better seal whilst the tab portion may be manufactured from a more resilient material than the elastic material so as to withstand the pulling force applied during removal of the removable seal.

Optionally, the tab portion is flexible and is configured to bend at the air inlet so to conform with an external profile of the housing. Alternatively, the tab portion may be hingedly connected to the seal portion at the air inlet such that the tab portion conforms with an external profile of the housing. More specifically, the tab portion may be arranged to fold at the air inlet during storage and transportation, such that it extends along the longitudinal axis of the housing. In other words, the tab portion can be stowed away prior to operation. As such, the tab portion causes minimal protrusion and the cartridge can be packed in more compacted packaging. To remove the removable seal, the tab portion may be straightened so that it is not parallel to the housing, before applying a lateral pulling force to remove the removable seal from the housing.

Optionally, the seal portion is arranged to provide a hermetic seal between the aerosol-generating element and the air flow passage. The provision of the hermetic seal prevents evaporation and/or loss of liquid substrate from the storage compartment to the atmosphere through the air flow passage, as well as inhibiting moisture ingress into the storage compartment that could affect the quality and stability of the liquid substrate.

Optionally, the storage compartment comprises a first compartment and a second compartment connected to one another by a connector so that liquid in the first compartment can pass to the second compartment through a liquid passage of the connector; and wherein the first surface of the fluid permeable aerosol-generating element faces the first compartment and the second surface faces the second compartment, with the second surface in fluid communication with the second compartment, so that liquid aerosol-forming substrate in the first compartment can reach the fluid permeable aerosol-generating element only through the second compartment. In other words, the first compartment and the second compartment may be connected by a connector configured to allow liquid to pass from the first compartment to the second compartment through a liquid passage of the connector The connector sealingly connects two discrete compartments and provides one or more liquid passages therebetween. More specifically, the connector is separate to both first compartment and the second compartment. The connector may be connected to the first compartment and/or the second compartment by an interference fit, which resiliently deforms to provide a seal at the connection. This enables individual parts to be mass produced cheaply by an extrusion or a moulding processing, before being assembled to form a more complex cartridge design. For example, this allows the aerosol-generating element to be moulded with the second compartment, prior to assembling onto the first compartment via the connector. The interference fit can be any suitable interference fit known to the person skilled in the art, for example the interference fit may be an interlock or it may be a snap fit.

Optionally, the connector and the first surface of the fluid permeable aerosol-generating element defines at least part of the air flow passage. The connector may define a wall of the air flow passage facing the fluid permeable aerosol-generating element. More specifically, the connector allows the seal portion of the removable seal to be positioned in the air flow passage over the first surface of the aerosol-generating element prior to assembly of the cartridge. This improves the access to the first surface because it is totally exposed when the seal portion is put in place.

Optionally, the airflow passage extends from the air inlet to the mouth end opening, and between the first compartment and the second compartment. That is, the connector not only provides liquid passage for the aerosol-generating substrate, it also defines a part of the air flow passage so to guide an air flow over the heater element and towards the mouth end opening.

Optionally, the air flow passage may extend through the first compartment. For example, the first compartment may have an annular cross section, with the air flow passage extending from the aerosol-generating element to the mouth end opening through the first compartment. Optionally, the air flow passage may extend from the aerosol-generating element to the mouth end opening adjacent to the first compartment.

Optionally, the connector may be produced from polypropylene (PP), high density polyethylene (HDPE), copolyester, thermoplastic elastomer (TPE), polysulfone (PSU) styrene ethylene butylene styrene (SEBS), polyethersulfone (PESU), rubber, silicone, or any suitable material known to the person skilled in the art. Optionally, the connector may be made from a material that is able to maintain mechanical integrity at temperatures up to 90° C. Optionally, the connector may be made from a material that is able to maintain mechanical integrity at temperatures up to 120° C.

Optionally, the first compartment has a larger liquid storage capacity than the second compartment. Optionally, the first compartment is larger than the second compartment.

In operation the first compartment is typically positioned above the aerosol-generating element. Optionally, the first compartment is positioned between the fluid permeable aerosol-generating element and the mouth end opening.

Optionally, the second compartment contains a capillary material in contact with the second surface of the aerosol-generating element. The capillary material delivers liquid aerosol-forming substrate to the aerosol-generating element against the force of gravity. By requiring the liquid aerosol-forming substrate to be move against the force of gravity to reach the aerosol-generating element, the possibility of liquid substrate leakage is reduced.

The capillary material may be made of a material capable of guaranteeing that there is liquid aerosol-forming substrate in contact with at least a portion of the second surface of the aerosol-generating element. The capillary material may extend into interstices or apertures in the aerosol-generating element. The aerosol-generating element may draw liquid aerosol-forming substrate into the interstices or apertures by capillary action.

A capillary material is a material that actively conveys liquid from one end of the material to another. The capillary material may have a fibrous or spongy structure. The capillary material comprises a bundle of capillaries. For example, the capillary material may comprise a plurality of fibers or threads or other fine bore tubes. The fibers or threads may be generally aligned to convey liquid aerosol-forming substrate towards the aerosol-generating element. Alternatively, the capillary material may comprise sponge-like or foam-like material. The structure of the capillary material forms a plurality of small bores or tubes, through which the liquid aerosol-forming substrate can be transported by capillary action. The capillary material may comprise any suitable material or combination of materials. Examples of suitable materials are a sponge or foam material, ceramic- or graphite-based materials in the form of fibers or sintered powders, foamed metal or plastics material, a fibrous material, for example made of spun or extruded fibers, such as cellulose acetate, polyester, or bonded polyolefin, polyethylene, ethylene or polypropylene fibers, nylon fibers or ceramic. The capillary material may have any suitable capillarity and porosity so as to be used with different liquid physical properties. The liquid aerosol-forming substrate has physical properties, including but not limited to viscosity, surface tension, density, thermal conductivity, boiling point and vapour pressure, which allow the liquid aerosol-forming substrate to be transported through the capillary medium by capillary action.

Alternatively, or in addition, the storage compartment may contain a carrier material for holding a liquid aerosol-forming substrate. The carrier material may be in the first compartment, the second compartment or both the first and second compartment. The carrier material may be a foam, and sponge of collection of fibers. The carrier material may be formed from a polymer or co-polymer. In one embodiment, the carrier material is a spun polymer. The aerosol-forming substrate may be released into the carrier material during operation. For example, the liquid aerosol-forming substrate may be provided in a capsule.

Optionally, the cartridge comprises a heater assembly, the heater assembly comprising the heater element and electrical contact portions, electrically connected to the heater element, wherein the contact portions are exposed through a connection end of the cartridge, so to allow for contact with electrical contact pins in a control body of an aerosol-generating system. The connection end is remote to a mouth end featuring the mouth end opening. The connection end configured to connect to a control body of an aerosol-generating system. The second side of the aerosol-generating element may face the connection end and the first side of the aerosol-generating element may face the mouth end. Electrical power may be delivered to the aerosol-generating element from a connected control body through the connection end of the housing.

Optionally, the electrical contact portions are two electrically conductive contact pads. The electrically conductive contact pads may be positioned at an edge area of the heater element. Optionally, the at least two electrically conductive contact pads may be positioned on extremities of the heater element. The electrically conductive contact pads may be fixed directly to electrically conductive filaments of the heater element. The electrically conductive contact pad may comprise a tin patch. Alternatively, the electrically conductive contact pads may be integral with the heater element.

Optionally, the aerosol-generating element is closer to the connection end than to the mouth end opening. This allows for a simple and short electrical connection path between a power source in the control body and the aerosol-generating element.

Optionally, the storage compartment may comprise a heater mount, the heater mount being moulded over the heater assembly.

Optionally, the first and second surfaces of the aerosol-generating element may be substantially planar. The aerosol-generating element may be a heater element. The heater element may comprise a substantially flat heater element to allow for simple manufacture. Geometrically, the term "substantially flat" heater element is used to refer to a heater element that is in the form of a substantially two dimensional plane. Thus, the substantially flat heater element extends in two dimensions along a surface substantially more than in a third dimension. In particular, the dimensions of the substantially flat heater element in the two dimensions within the surface is at least five times larger than in the third dimension, normal to the surface. An example of a substantially flat heater element is a structure between two substantially imaginary parallel surfaces, wherein the distance between these two imaginary surfaces is substantially smaller than the extension within the surfaces. In some embodiments, the substantially flat heater element is planar. In other embodiments, the substantially flat heater element is curved along one or more dimensions, for example forming a dome shape or bridge shape.

The heater element may comprise a plurality of interstices or apertures extending from the second surface to the first surface and through which fluid may pass.

The heater element may comprise a plurality of electrically conductive filaments. The term "filament" is used throughout the specification to refer to an electrical path arranged between two electrical contacts. A filament may arbitrarily branch off and diverge into several paths or filaments, respectively, or may converge from several electrical paths into one path. A filament may have a round, square, flat or any other form of cross-section. A filament may be arranged in a straight or curved manner.

The heater element may be an array of filaments, for example arranged parallel to each other. In an embodiment, the filaments may form a mesh. The mesh may be woven or non-woven. The mesh may be formed using different types of weave or lattice structures. Alternatively, the electrically conductive heater element consists of an array of filaments or a fabric of filaments. The mesh, array or fabric of electrically conductive filaments may also be characterized by its ability to retain liquid.

In a preferred embodiment, a substantially flat heater element may be constructed from a wire that is formed into a wire mesh. In an embodiment, the mesh has a plain weave design. Optionally, the heater element is a wire grill made from a mesh strip.

The electrically conductive filaments may define interstices between the filaments and the interstices may have a width of between 10 micrometres and 100 micrometres. In an embodiment, the filaments give rise to capillary action in the interstices, so that in operation, liquid to be vaporized is drawn into the interstices, increasing the contact area between the heater element and the liquid aerosol-forming substrate.

The electrically conductive filaments may form a mesh of size between 60 and 240 filaments per centimetre (+/−10 percent). In an embodiment, the mesh density is between 100 and 140 filaments per centimetres (+/−10 percent). In another embodiment, the mesh density is approximately 115 filaments per centimetre. The width of the interstices may be between 100 micrometres and 25 micrometres, or between 80 micrometres and 70 micrometres, or approximately 74 micrometres. The percentage of open area of the mesh, which is the ratio of the area of the interstices to the total area of the mesh may be between 40 percent and 90 percent, or between 85 percent and 80 percent, or approximately 82 percent.

The electrically conductive filaments may have a diameter of between 8 micrometres and 100 micrometres, or between 10 micrometres and 50 micrometres, or between 12 micrometres and 25 micrometres, or approximately 16 micrometres. The filaments may have a round cross section or may have a flattened cross-section.

The area of the mesh, array or fabric of electrically conductive filaments may be small, for example less than or equal to 50 square millimetres, or less than or equal to 25 square millimetres, or approximately 15 square millimetres. The size is chosen such to incorporate the heater element into a handheld system. Sizing of the mesh, array or fabric of electrically conductive filaments less or equal than 50 square millimetres reduces the amount of total power required to heat the mesh, array or fabric of electrically conductive filaments while still ensuring sufficient contact of the mesh, array or fabric of electrically conductive filaments to the liquid aerosol-forming substrate. The mesh, array or fabric of electrically conductive filaments may, for example, be rectangular and have a length between 2 millimetres to 10 millimetres and a width between 2 millimetres and 10 millimetres. In an embodiment, the mesh has dimensions of approximately 5 millimetres by 3 millimetres.

The filaments of the heater element may be formed from any material with suitable electrical properties. Suitable materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group.

Examples of suitable metal alloys include stainless steel, constantan, nickel-, cobalt-, chromium-, aluminum-, titanium-, zirconium-, hafnium-, niobium-, molybdenum-, tantalum-, tungsten-, tin-, gallium-, manganese- and iron-containing alloys, and super-alloys based on nickel, iron, cobalt, stainless steel, Timetal®, iron-aluminum based alloys and iron-manganese-aluminum based alloys. Timetal® is a registered trade mark of Titanium Metals Corporation. The filaments may be coated with one or more insulators. Some materials for the electrically conductive filaments are stainless steel, and graphite. More specifically material for the electrically conductive filaments may be 300 series stainless steel like AISI 304, 316, 304L, 316L. Additionally, the electrically conductive heater element may comprise combinations of the above materials. A combination of materials may be used to improve the control of the resistance of the substantially flat heater element. For example, materials with a high intrinsic resistance may be combined with materials with a low intrinsic resistance. This may be advantageous if one of the materials is beneficial from a standpoint of price, machinability or other physical and chemical parameters. Advantageously, a substantially flat filament arrangement with increased resistance reduces parasitic losses. Advantageously, high resistivity heaters allow more efficient use of battery energy.

Optionally, the filaments are made of wire. Optionally, the wire is made of metal, such as stainless steel.

The electrical resistance of the mesh, array or fabric of electrically conductive filaments of the heater element may be between 0.3 Ohms and 4 Ohms. Optionally, the electrical resistance is equal or greater than 0.5 Ohms. In an embodiment, the electrical resistance of the mesh, array or fabric of electrically conductive filaments is between 0.6 Ohms and 0.8 Ohms, or about 0.68 Ohms. The electrical resistance of the mesh, array or fabric of electrically conductive filaments is at least an order of magnitude, and or at least two orders of magnitude, greater than the electrical resistance of electrically conductive contact areas. This ensures that the heat generated by passing current through the heater element is localized to the mesh or array of electrically conductive filaments. It is advantageous to have a low overall resistance for the heater element if the system is powered by a battery. A low resistance, high current system allows for the delivery of high power to the heater element. This allows the heater element to heat the electrically conductive filaments to a desired temperature quickly.

Alternatively, the heater element may comprise a heating plate in which an array of apertures is formed. The apertures may be formed by etching or machining, for example. The plate may be formed from any material with suitable electrical properties, such as the materials described above in relation to filaments of a heater element.

The first surface of the aerosol-generating element may directly face the mouth end opening. This orientation of a planar aerosol-generating element allows for simple assembly of the cartridge during manufacture.

The storage compartment may comprise a storage compartment housing. The storage compartment housing may comprise a heater mount, the heater mount being moulded over the heater assembly. The heater mount may cover a portion of the first surface of the heater assembly to isolate the electrical contact portions from the airflow passage and may cover at least a portion of the second surface of the heater assembly to isolate the electrical contact portions from the liquid aerosol-forming substrate.

The heater mount may comprise at least one wall extending from the second surface of the heater assembly, the at least one wall forming part of the second compartment. The heater mount may define a liquid flow path from a first surface of the heater assembly to a second surface of the heater assembly.

The liquid storage compartment may hold liquid aerosol-forming substrate. As used herein with reference to the present example embodiments, an aerosol-forming substrate is a substrate capable of releasing volatile compounds that can form an aerosol. Volatile compounds may be released by heating the aerosol-forming substrate. Volatile compounds may be released by moving the aerosol-forming substrate through passages of a vibratable element.

The aerosol-forming substrate may be liquid at room temperature. The aerosol-forming substrate may comprise both liquid and solid components. The liquid aerosol-forming substrate may comprise nicotine. The nicotine containing liquid aerosol-forming substrate may be a nicotine salt matrix. The liquid aerosol-forming substrate may comprise plant-based material. The liquid aerosol-forming substrate may comprise tobacco. The liquid aerosol-forming substrate may comprise a tobacco-containing material containing volatile tobacco flavour compounds, which are released from the aerosol-forming substrate upon heating. The liquid aerosol-forming substrate may comprise homogenised tobacco material. The liquid aerosol-forming substrate may comprise a non-tobacco-containing material. The liquid aerosol-forming substrate may comprise homogenised plant-based material.

The liquid aerosol-forming substrate may comprise one or more aerosol-formers. An aerosol-former is any suitable known compound or mixture of compounds that, in operation, facilitates formation of a dense and stable aerosol and that is substantially resistant to thermal degradation at the temperature of operation of the system. Examples of suitable aerosol formers include glycerine and propylene glycol. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. The liquid aerosol-forming substrate may comprise water, solvents, ethanol, plant extracts and natural or artificial flavours.

The liquid aerosol-forming substrate may comprise nicotine and at least one aerosol former. The aerosol former may be glycerine or propylene glycol. The aerosol former may comprise both glycerine and propylene glycol. The liquid aerosol-forming substrate may have a nicotine concentration of between about 0.5% and about 10%, for example about 2%.

The housing may be formed form a mouldable plastics material, such as polypropylene (PP) or polyethylene terephthalate (PET). The housing may form a part or all of a wall of the storage compartment. The housing and storage compartment may be integrally formed. Alternatively the storage compartment may be formed separately from the housing and assembled to the housing.

The cartridge may comprise a removable mouthpiece through which aerosol may be discharged. The removable mouthpiece may cover the mouth end opening. Alternatively the cartridge may be configured to allow discharge directly on the mouth end opening. The cartridge may be refillable with liquid aerosol-forming substrate. Alternatively, the cartridge may be designed to be disposed of when the storage compartment becomes empty of liquid aerosol-forming substrate. In another example embodiment, there is provided a cartridge for an aerosol-generating system including a housing, a storage compartment, an airflow passage, and a fluid permeable aerosol-generating element. The housing has a mouth end opening and an air inlet. The storage compartment is within the housing and is configured to contain a liquid aerosol-forming substrate; the storage compartment having a first compartment and a second compartment connected to one another by a connector so that liquid in the first compartment can pass to the second compartment through a liquid passage in the connector. The air flow passage extends from the air inlet to the mouth end opening, the air flow passage passing between the first compartment and the second compartment of the storage compartment. The fluid permeable aerosol-generating element has a first surface and a second surface opposite to the first surface, wherein the first surface of the fluid permeable aerosol-generating element faces the first compartment and the second surface faces the second compartment, with the second surface in fluid communication with the second compartment, so that liquid aerosol-forming substrate in the first compartment can reach the fluid permeable aerosol-generating element only through the second compartment, wherein the first surface and the connector forms part of the air flow passage. The liquid aerosol-forming substrate in the first compartment can reach the fluid permeable aerosol-generating element only through the connector and the second compartment.

Features of the cartridge of the example embodiments may be applied to other example embodiments.

In another example embodiment there is provided an aerosol-generating system comprising a cartridge in accordance with any one of the first or second aspect and a control body connected to the cartridge, the control body configured to control a supply of electrical power to the aerosol-generating element.

The control body may comprise at least one electrical contact element configured to provide an electrical connection to the aerosol-generating element when the control body is connected to the cartridge. The electrical contact element may be elongate. The electrical contact element may be spring-loaded. The electrical contact element may contact an electrical contact pad in the cartridge.

The control body may comprise a connecting portion for engagement with the connection end of the cartridge.

The control body may comprise a power supply.

The control body may comprise control circuitry configured to control a supply of power from the power supply to the aerosol-generating element.

The control circuitry may comprise a microcontroller. The microcontroller is a programmable microcontroller. The control circuitry may comprise further electronic components. The control circuitry may be configured to regulate a supply of power to the aerosol-generating element. Power may be supplied to the aerosol-generating element continuously following activation of the system or may be supplied intermittently, such as on a puff-by-puff basis. The power may be supplied to the aerosol-generating element in the form of pulses of electrical current.

The control body may comprise a power supply arranged to supply power to at least one of the control system and the aerosol-generating element. The aerosol-generating element may comprise an independent power supply. The aerosol-generating system may comprise a first power supply arranged to supply power to the control circuitry and a second power supply configured to supply power to the aerosol-generating element.

The power supply may be a DC power supply. The power supply may be a battery. The battery may be a Lithium based battery, for example a Lithium-Cobalt, a Lithium-Iron-Phosphate, a Lithium Titanate or a Lithium-Polymer battery. The battery may be a Nickel-metal hydride battery or a Nickel cadmium battery. The power supply may be another form of charge storage device such as a capacitor. The power supply may require recharging and be configured for many cycles of charge and discharge. The power supply may have a capacity that allows for the storage of enough energy for one or more operations of the system; for example, the power supply may have sufficient capacity to allow for the continuous generation of aerosol for a period of around six minutes, corresponding to the typical time taken to smoke a conventional cigarette, or for a period that is a multiple of six minutes. In another example, the power supply may have sufficient capacity to allow for a predetermined number of puffs or discrete activations of the atomising assembly.

The aerosol-generating system may be a handheld aerosol-generating system configured to allow suction on a mouthpiece to draw an aerosol through the mouth end opening. The aerosol-generating system may have a size comparable to a conventional cigar or cigarette. The aerosol-generating system may have a total length between about 30 mm and about 150 mm. The aerosol-generating system may have an external diameter between about 5 mm and about 30 mm.

The cartridge or aerosol-generating system in any of the example embodiments may comprise a puff detector in communication with the control circuitry. The puff detector may be configured to detect a discharge through the airflow passage.

The cartridge or aerosol-generating system in any of the example embodiments may comprise a temperature sensor in communication with the control circuitry. The cartridge or aerosol-generating system may comprise an input, such as a switch or button. The input may enable the system to be turned on and off.

The cartridge or aerosol-generating system may also comprise indication means for indicating the determined amount of liquid aerosol-forming substrate held in the liquid storage portion. The control circuitry may be configured to activate the indication means after a determination of the amount of liquid aerosol-forming substrate held in the liquid storage portion has been made.

The indication means may comprise one or more of lights, such as light emitting diodes (LEDs), a display, such as an LCD display and audible indication means, such as a loudspeaker or buzzer and vibrating means. The control circuitry may be configured to light one or more of the lights, display an amount on the display, emit sounds via the loudspeaker or buzzer and vibrate the vibrating means.

In another example embodiment there is provided an aerosol-generating system including a housing, a storage compartment, an air flow passage, a fluid permeable aerosol-generating element, and a removable seal. The housing having a mouth end opening and an air inlet. The storage compartment is within the housing and is configured to contain a liquid aerosol-forming substrate. The air flow passage extends from the air inlet to the mouth end opening. The fluid permeable aerosol-generating element is within the housing and has a first surface and a second surface opposing the first surface, the second surface being in fluid communication with the storage compartment. The removable seal has a seal portion and a tab portion in connection with the seal portion, the seal portion positioned in the air flow passage over the first surface of the aerosol-generating element, and the tab portion extend outwardly from the housing through the air inlet. The control body configured to control a supply of electrical power to the aerosol-generating element.

Features of example embodiment may be applied to the other example embodiments.

FIG. 1*a* is a schematic illustration of an aerosol-generating system. The aerosol-generating system comprises two main components, a cartridge 100 and a control body 200. A connection end 115 of the cartridge 100 is removably connected to a corresponding connection end 205 of the control body 200. The control body 200 contains a battery 210, which in this example is a rechargeable lithium ion battery, and control circuitry 220. The aerosol-generating device is portable and has a size comparable to a conventional cigar or cigarette.

Figure 1C:
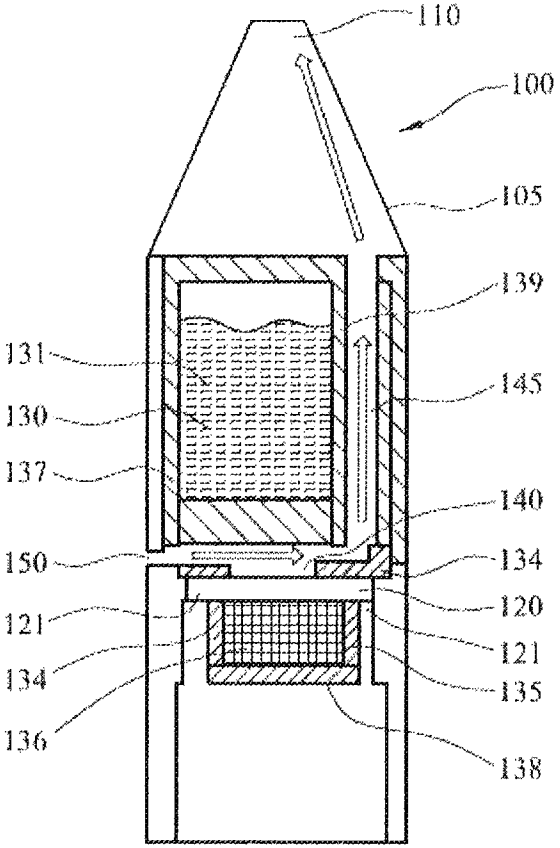
FIG. 1*c* is a schematic illustration of a second cross-section of the cartridge as shown in FIG. 1*a;*
Figure 1B:
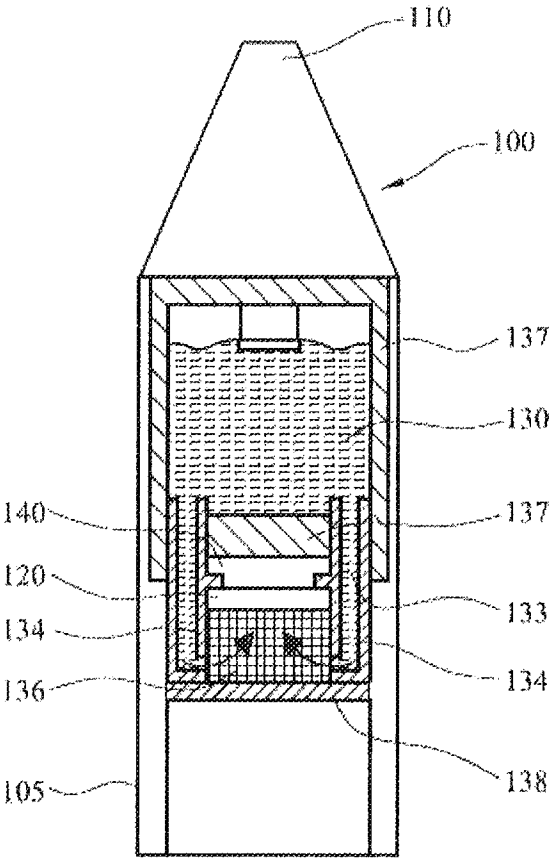
FIG. 1*b* is a schematic illustration of a first cross-section of the cartridge as shown in FIG. 1*a;*

The cartridge 100 comprises a housing 105 containing an atomising assembly (heater assembly) 120 and a liquid storage compartment having a first portion/compartment 130 and a second portion/compartment 135. A liquid aerosol-forming substrate is held in the liquid storage compartment. As can be seen in FIG. 1*b*, the first portion 130 of the liquid storage compartment is connected to the second portion 135 of the liquid storage compartment so that liquid in the first portion 130 can pass to the second portion 135. The heater assembly 120 receives liquid from the second portion 135 of the liquid storage compartment. In this embodiment, the heater assembly 120 is a generally planar, fluid permeable heater assembly.

An air flow passage 140 (including a vertical portion 145 of the air flow passage 140) extends through the cartridge 100 from an air inlet 150 past the heater assembly 120 and from the heater assembly 120 to a mouth end opening 110 in the cartridge housing 105.

The components of the cartridge 100 are arranged so that the first portion 130 of the liquid storage compartment is between the heater assembly 120 and the mouth end opening 110, and the second portion 135 of the liquid storage compartment is positioned on an opposite side of the heater assembly 120 to the mouth end opening 110. In other words, the heater assembly 120 lies between the two portions 130, 135 of the liquid storage compartment and receives liquid from the second portion 135, and the first portion 130 of liquid storage compartment is closer to the mouth end opening 110 than the second portion 135 of the liquid storage compartment. The air flow passage extends past the heater assembly 120 and between the first and second portion 130, 135 of the liquid storage compartment.

The system is configured so that a puff or suction on the mouth end opening 110 of the cartridge 100 draws aerosol from the system. In operation, when drawing on the mouth end opening 110, air is drawn or discharged through the airflow passage from the air inlet 150, past the heater assembly 120, to the mouth end opening 110. The control circuitry 220 controls the supply of electrical power from the battery 210 to the cartridge 100 when the system is activated. Consequently, the amount and properties of the vapour produced by the heater assembly 120 are controlled. The control circuitry 220 may include an airflow sensor and the control circuitry 220 may supply electrical power to the heater assembly 120 (also called a "vaporizer assembly" or a "vapor generator") when a puff on the cartridge 100 is detected by the airflow sensor. This type of control arrangement is well established in aerosol-generating systems such as inhalers and e-cigarettes. So when suction is applied on the mouth end opening 110 of the cartridge 100, the heater assembly 120 is activated and generates a vapour that is entrained in the air flow passing through the air flow passage 140. The vapour cools with in the vertical portion 145 of the air flow passage 140 to form an aerosol, which is then discharged through the mouth end opening 110. Thus, the atomizing assembly 120 may also be referred to as an "aerosol assembly" or an "aerosol generating assembly."

In operation, the mouth end opening 110 is typically the highest point of the device. The construction of the cartridge 100, and in particular the arrangement of the heater assembly 120 between first and second portions 130, 135 of the liquid storage compartment, is advantageous because it exploits gravity to ensure that the liquid substrate is delivered to the heater assembly 120 even as the liquid storage compartment is becoming empty, but prevents an oversupply of liquid to the heater assembly 120.

FIG. 1*b* is a first cross section of a cartridge 100 for use in the system of FIG. 1*a*. FIG. 1*c* is a second cross section, orthogonal to the cross section of FIG. 1*b*.

The cartridge 100 of FIGS. 1*b* and FIG. 1*c* comprises an external housing 105 having a mouth end with a mouth end opening 110, and a connection end opposite the mouth end. Within the housing 105 is the liquid storage compartment holding a liquid aerosol-forming substrate 131. The liquid is contained in the liquid storage compartment by three components, an upper storage compartment housing 137, a heater mount 134 and an end cap 138. A heater assembly 120 is held in the heater mount 134. A capillary material 136 is provided in the second portion 135 of the liquid storage compartment, and abuts the heater element in a central region of the heater assembly 120. The capillary material is oriented to transport liquid to the heater element. The heater element 121 comprises a mesh heater element, formed from a plurality of filaments. Details of this type of heater element construction can be found in WO2015/117702 for example. An airflow passage 140 extends between the first and second portions 130, 135 of the liquid storage compartment. A bottom wall of the airflow passage 140 comprises the heater element 121 and the heater mount 134, side walls of the airflow passage 140 comprise portions of the heater mount 134, and a top wall of the airflow passage 140 comprises a portion of the upper storage compartment housing 137. The air flow passage 140 has the vertical portion 145 that extends through the first portion 130 of the liquid storage compartment, as shown in FIG. 1*b*, towards the mouth end opening 110.

The heater assembly 120 is generally planar and has two faces. A first face of the heater assembly 120 faces the first portion 130 of the liquid storage compartment and the mouth end opening 110. A second face of the heater assembly 120 is in contact with the capillary material 136 and the liquid 131 in the liquid storage compartment, and faces a connection end 115 of the cartridge 100. The heater assembly 120 is closer to the connection end so that electrical connection of the heater assembly 120 to a power supply can be easily and robustly achieved, as will be described. The first portion 130 of the liquid storage compartment is larger than the second portion 135 of the liquid storage compartment and occupies a space between the heater assembly 120 and the mouth end opening 110 of the cartridge 100. Liquid in the first portion 130 of the liquid storage compartment can travel to the second portion 135 of the liquid storage compartment through liquid channels 133 on either side of the heater assembly 120. Two channels are provided in this example to provide a symmetric structure, although only one channel is necessary. The channels are enclosed liquid flow paths defined between the upper storage compartment housing 137 and the heater mount 134.

Figure 2A:
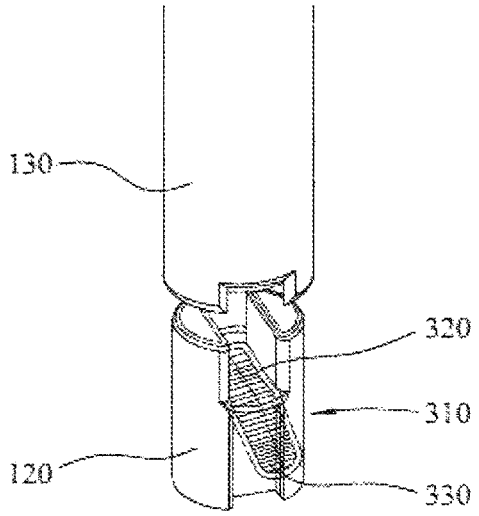
FIGS. 2*a* and 2*b* illustrate the fitting of a removable seal to the cartridge of FIGS. 1*a*-1*c;*
Figure 2B:
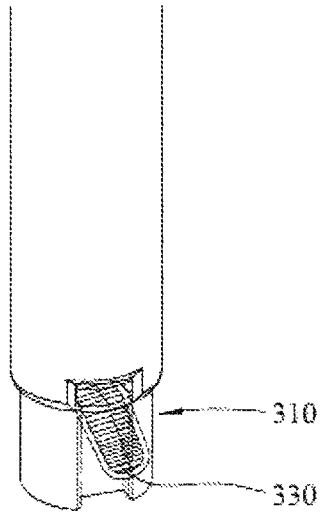
Figure 2C:
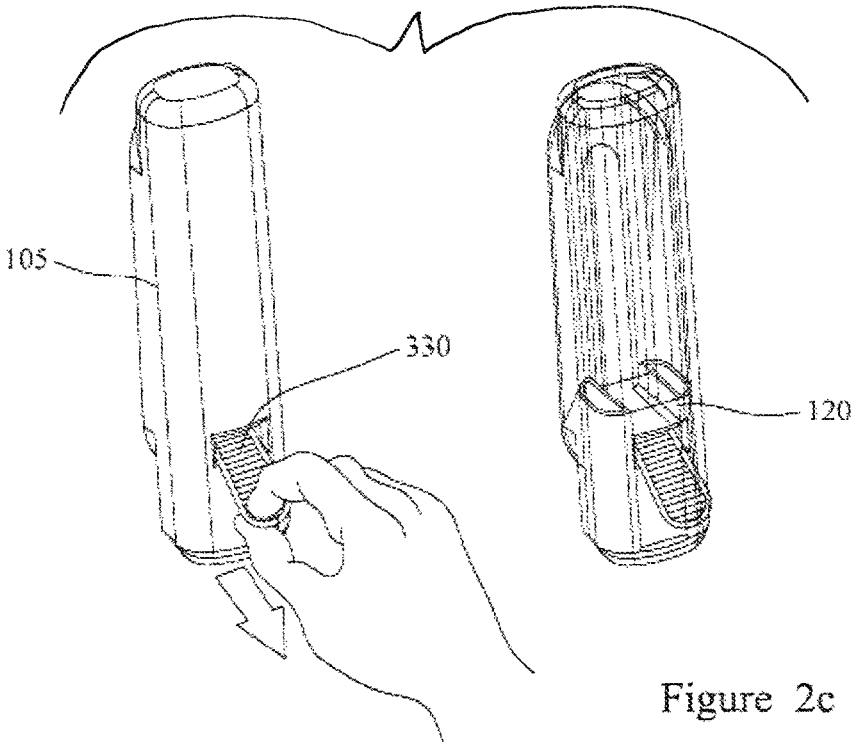
FIG. 2*c* illustrates the removal of the removable seal as illustrated in FIGS. 2*a* and 2*b;*

FIGS. 2*a*, 2*b* and 2*c* illustrate an example embodiment in relation to the cartridge shown in FIGS. 1*a* to 1*c*. In FIG. 2*a*, the heater assembly 120 is shown being assembled onto the first portion 130 of the storage compartment where a seal portion 320 of a removable seal 310 is positioned over the heater element 121 so to seal off a first side of the heater element 121 that is exposed to the air flow passage 140. FIGS. 2*b* and 2*c* show an assembled heater assembly 120 with the first portion 130 of the storage compartment and the finished cartridge respectively. A tab portion 330 of the removable seal 310 in shown extending outwardly from the air flow passage and protruding from the external surface of the housing 105. The tab portion 330 allows removal of the seal portion 320 of the removable seal 310 from the air flow passage 140 by pulling on the tab portion 330, thereby establishing fluid communication between the heater element and the air flow passage 140.

Figure 3:
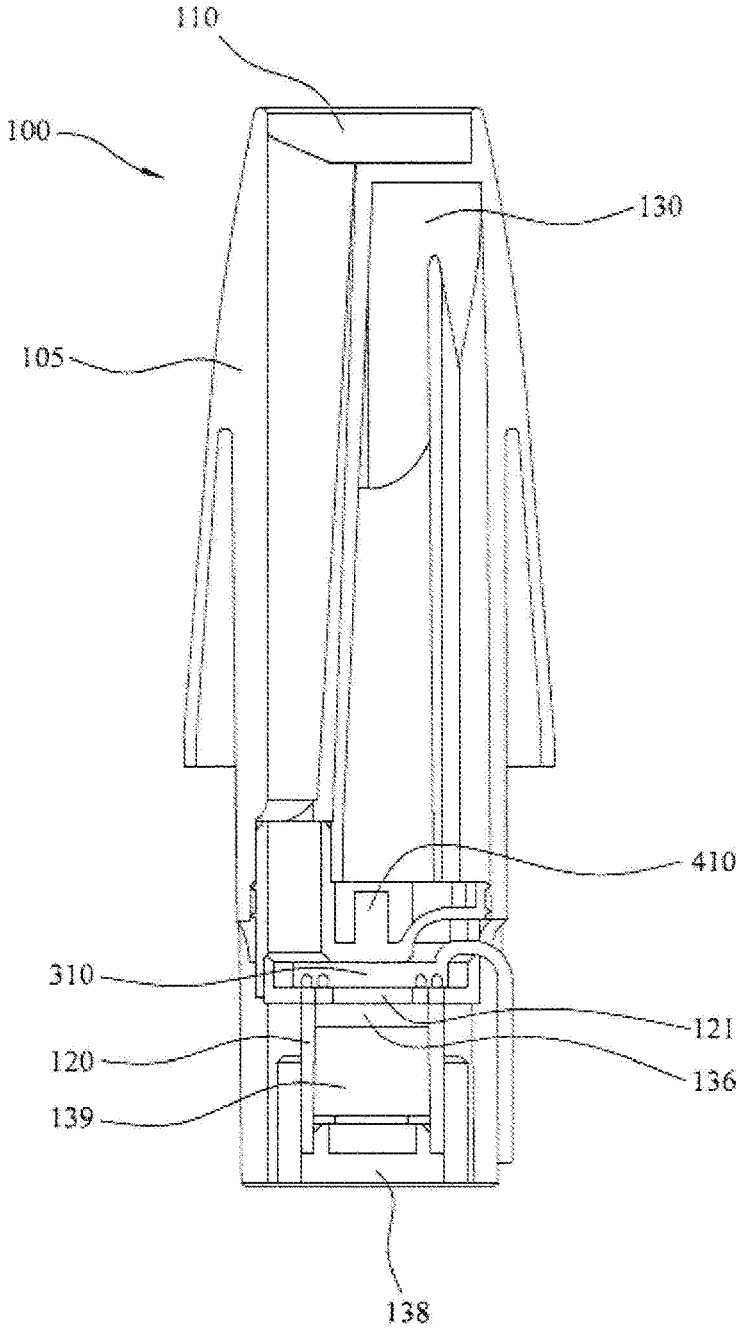
FIG. 3 is a cross-section of a cartridge according to another example embodiment.

FIG. 3 is a cross-section of another example embodiment. In this embodiment, a seal joint 410 is provided between the first portion 130 of the storage compartment and the heater assembly 120, which is moulded with the second portion 135 of the storage compartment. The seal joint 410 not only simplifies the manufacturing process, since the second portion 135 and the first portion 130 of the storage compartment can be separately produced before being sealingly attached to each other so as to establish the liquid channels 133, such seal joint 410 also defines part of the air flow passage 140 and this allows the seal portion 320 of the removable seal 310 to be attached to the heater element 121 more easily. The seal joint 410 can also be shaped in order to direct air flow over the heater element 121, for example, it can be shaped to create turbulence over the surface of the heater element 121 so as to improve vaporisation.

Figure 4B:
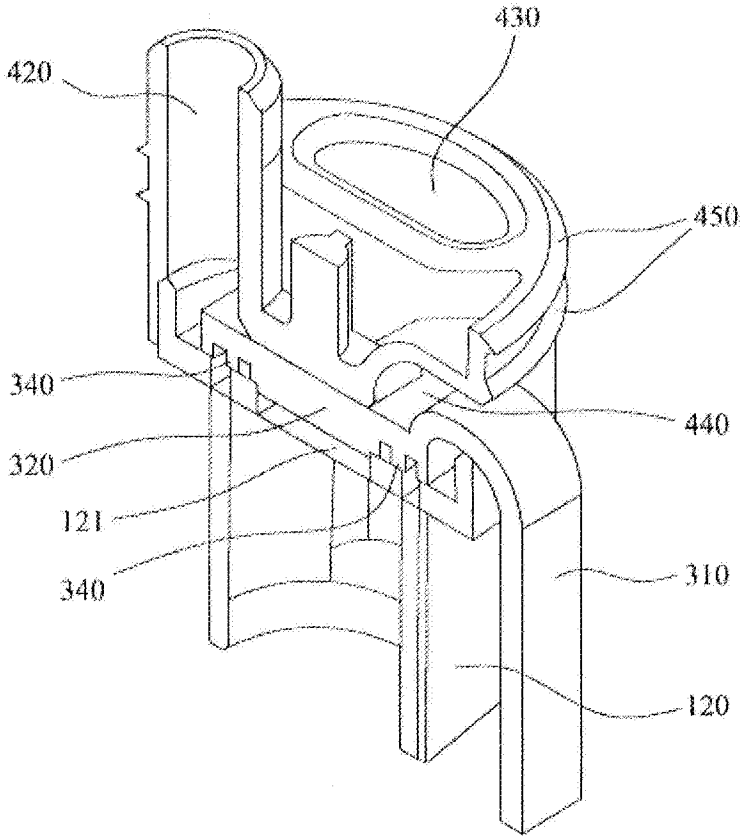
FIGS. 4*a* and 4*b* are a perspective views of a heater assembly for the cartridge as illustrated in FIG. 3.
Figure 4A:
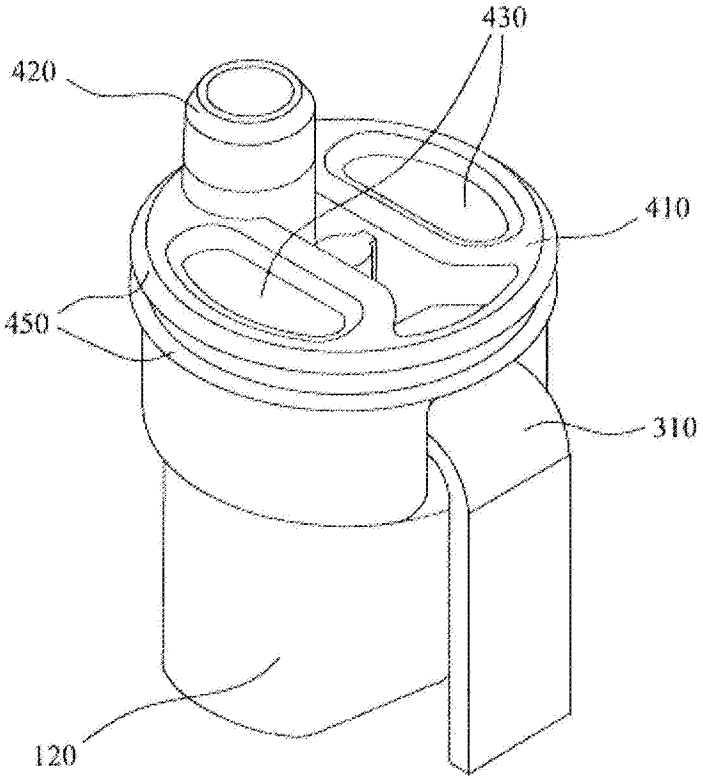

FIGS. 4*a* and 4*b* are perspective views of exterior and cross-section of a heater assembly 120 connected to a seal joint 410. The seal joint 410 forms part of the air flow passage 140, extending from an air inlet end 440 towards a cartridge end 420. The cartridge end 420 is configured to cooperate sealingly with a corresponding connection at the housing 105 so to complete the air flow passage 140. The connection between the seal joint 410 to the heater assembly 120 as shown in FIGS. 4*a* and 4*b*, as well as the connection between the seal joint 140 and the housing 105, are both effected by an interference fit in order to provide sealed connections. The interference fit, shown in FIG. 4*b* as a pair of ribs protruding from and along the circumference of an exterior surface of the seal joint 410, are compressed as the seal joint is mated with the housing 105 to provide a seal at the connection. Similar ribs (not shown) are arranged to protrude from and along the circumference of the inner surface of the seal joint 410 to form a seal at the connection with the heater assembly 120. The ribs 450, in the illustrated embodiment, are integrally formed with the seal joint 410 where both the ribs and the seal joint 410 are made from the same material. However, the ribs 450 can be replaced by elastomer O-rings or any other materials different to that of the seal joint 410.

In the particular embodiment shown in FIG. 4*b*, the seal portion 320 of the removable seal 310 engages with the heater assembly 120 by a mechanical seal 340. That is, a ring of protrusion on the mechanical seal 340 engages with a corresponding grooved ring on the heater assembly 120, thus locking the seal portion 320 in position. The mechanical seal 340 is made from resilient material and its attachment to the grooved ring creates a hermetic seal between the heater element 121 and the air flow passage 140. The use of such mechanical seal 340 not only prevents leakage of liquid substrate during transportation and storage, it also prevents evaporation of liquid substrate from the second portion 135 of the storage compartment. The mechanical seal 340 is configured to disengage from the heater assembly upon applying a pulling force on the tab portion 330.

The seal portion 320, when positioned in the air flow passage 140, not only covers and seals the first side of the heater element 121 from the air flow passage, it also blocks off the air flow passage 140 so to prevent dust and dirt from collecting therein.

The seal joint 410 also comprises fluid passage connection 430 for connecting sealingly to a corresponding connector at the first portion 130 of the storage compartment by an interference seal, so to provide a sealed liquid passage between the first portion 130 and the second portion 135 of the storage compartment.

Figure 5A:
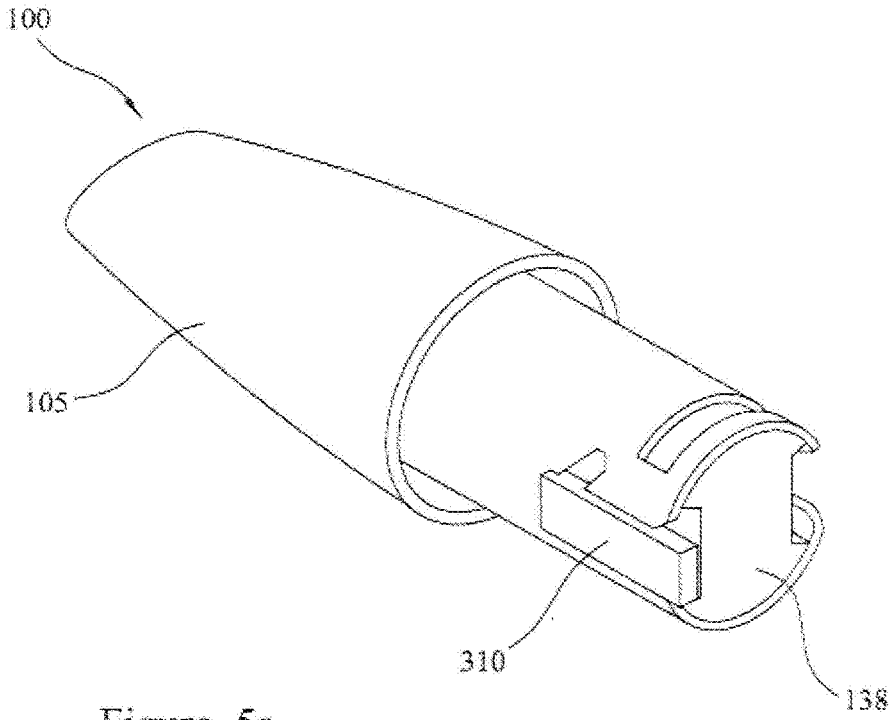
FIG. 5*a* is a perspective view of the cartridge as shown in FIG. 3.
Figure 5B:
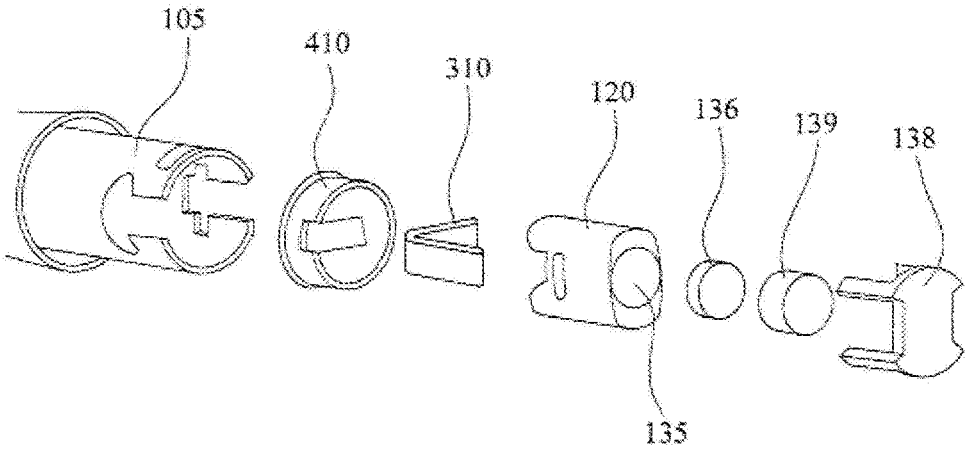
FIG. 5*b* is an exploded view of the cartridge as illustrated in FIG. 5*a*.

FIG. 5*a* is a perspective view of the assembled cartridge shown in FIG. 3, whereas an exploded view of which is also provided in FIG. 5*b*. In FIG. 5*a*, the removable seal 310 is placed in the air passage 140 having its seal portion 320 positioned over the heater element 121, and the tab portion 330 extending beyond the cartridge housing. As shown in FIG. 5*b*, the removable seal 310 is shown to have an "L" shaped profile. That is, the removable seal 310 is bent such that the tap portion 330 is arranged perpendicularly to the seal portion 320 so to conform to the exterior profile of the cartridge housing 105. This ensures more compact cartridges can be produced.

Prior to its first operation, the tab portion 330 may be gripped and pull it outwardly away from the housing 105 in order to remove the removable seal 310 from the air passage. This causes the break up of the hermetic seal between the seal portion 320 and the heater element 121, and allowing the liquid substrate from the second portion 135 of the storage compartment to expose to the atmosphere. Once the removable seal is removed the connection end 115 of the cartridge 100 may be connected to a corresponding connection end 205 of the control body 200.

The removable seal also prevents dirt and dust from collecting in the air flow passage 140 and the heater element. In addition, the tab portion 330 also prevents accidental connection of the cartridge onto the control body 200 prior to its removal because the tab portion 330 would otherwise be in the way of connection. More specifically, the tab portion 330 prevents the heater element being energised before the removable seal is removed.

FIG. 5*b* illustrates an exploded view of the exemplary cartridge of FIG. 3. The first portion of the storage compartment is manufactured integrally with the cartridge housing 105 by an injection moulding process. The heater assembly 120 is first produced by moulding the heater element with the heater assembly 120, which forms integrally with the second portion of the storage compartment 135. The heater assembly 120 comprises electrical contact pads for providing electrical connection to the control circuitry 220.

A retention material 139 and capillary material 136 are then inserted into the second portion 135 of the storage compartment before the second portion 135 is closed off by an end cap 138. The retention material 139 is a fibrous material provided to contain any incoming liquid substrate from the first portion 130, before it is drawn towards the capillary material and be consumed at the heater element. The end cap 138 attaches sealingly onto the second portion 135 by an interference fit to keep the capillary material contained in the second portion, as well as prevent leakage and evaporation of liquid substrate from the second portion 135 of the storage compartment.

The removable seal is then positioned over the heater element to seal it in place. Although a mechanical sealing means 340 is used in this exemplary embodiment, the seal portion 320 of the removable seal 310 may be secured onto the heater element by other cap sealing mechanisms such as induction sealing or glued sealing. The seal joint 410 may then installed onto the heater assembly 120 by interference fit, to form the example as shown in FIGS. 4*a* and 4*b*. The use of a seal joint 410 is particularly beneficial because the heater element is fully exposed during the application of cap seal, thus providing sufficient free space for an induction sealer or a heat sealer to operate on the cap seal.

The completed heater assembly 120, with the seal joint 410 attached, is attached onto the cartridge housing 105 via interference fit to form the cartridge as shown in FIG. 3 and FIG. 5*a*.

Figure 6:
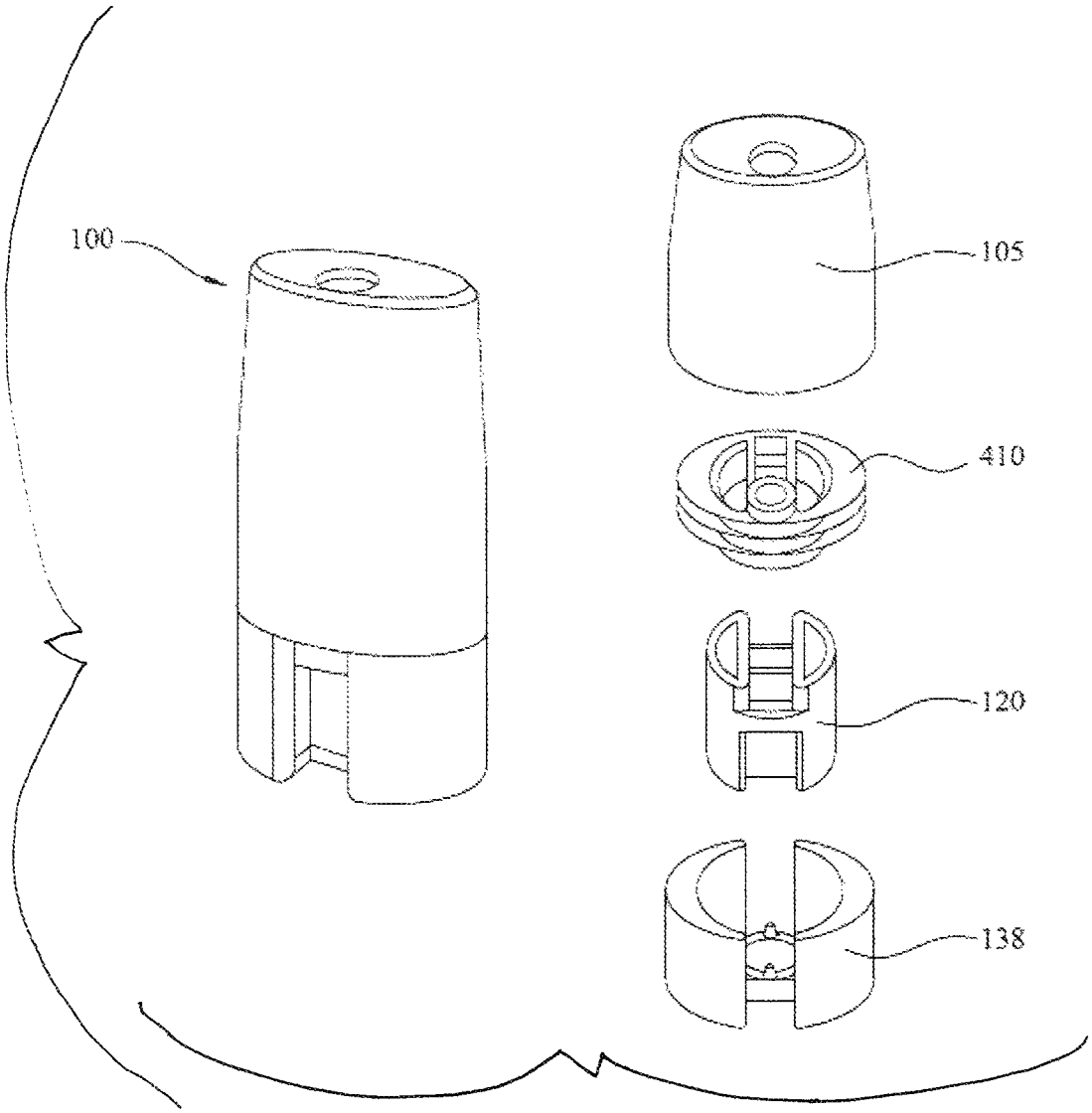
FIG. 6 is an exploded view of a cartridge according to yet another example embodiment.

FIG. 6 shows another example embodiment but without the removable seal 310 in place. The cartridge 100 as shown in FIG. 6 is of similar construction to the example as shown in FIG. 3 to 5, as such a removable seal 310 can be applied in a similar manner. More specifically, the embodiment shown in FIG. 6 comprises a first portion 130 of storage compartment formed integrally with the housing 105, a heater assembly formed integrally with a second portion 135 of the storage compartment, and an end cap 138 that is designed to cooperate directly with the housing 105 via an interference fit. That is, the end cap 138 in FIG. 6 is designed to lock onto the housing 105, instead of the heater assembly as shown in FIGS. 3 and 5. This further simplifies the manufacturing process.

It should also be clear that alternative geometries are possible within the scope of the example embodiments. The cartridge and liquid storage compartment may have a different cross-sectional shape and the heater assembly may have a different shape and configuration.

The invention claimed is:

1. A cartridge for an aerosol-generating system, the cartridge comprising:

a housing having a mouth end opening and an air inlet;

a storage compartment within the housing, the storage compartment configured to contain a liquid aerosol-forming substrate, the storage compartment including a first compartment in fluid communication with a second compartment, the first compartment being in communication with the second compartment via at least one liquid channel defined within the cartridge;

an air flow passage extending from the air inlet to the mouth end opening;

a fluid permeable aerosol-generating element within the housing, the fluid permeable aerosol-generating element having a first planar surface and a second planar surface opposing the first planar surface, the second planar surface being in fluid communication with the second compartment, the first planar surface defining at least part of the air flow passage, the first planar surface being between the first compartment and the second compartment, the storage compartment and the at least one liquid channel being adapted to communicate the liquid aerosol-forming substrate from the first compartment to the second compartment in a first direction before reversing course and communicating the liquid aerosol-forming substrate within the second compartment towards the first planar surface in a second direction, the first direction being opposite to the second direction; and a removable seal having a seal portion and a tab portion in connection with the seal portion, the seal portion in the air flow passage over the first planar surface of the fluid permeable aerosol-generating element, and the tab portion extending outwardly from the housing through the air inlet.

2. The cartridge of claim 1, wherein removal of the seal portion from over the first planar surface by applying a pulling force on the tab portion, places the first planar surface in fluid communication with the air flow passage.

3. The cartridge of claim 2, wherein the removable seal comprises a retainer configured to retain the removable seal over the air flow passage until the pulling force is applied on the tab portion.

4. The cartridge of claim 1, wherein the removable seal is removable from the air flow passage through the air inlet.

5. The cartridge of claim 1, wherein the tab portion is flexible and is configured to bend at the air inlet so to conform with an external profile of the housing.

6. The cartridge of claim 1, wherein the seal portion is arranged to provide a hermetic seal between the fluid permeable aerosol-generating element and the air flow passage.

7. The cartridge of claim 1, wherein the storage compartment includes a connector defining a liquid passage, the liquid passage being configured to allow the liquid aerosol-forming substrate to pass from the first compartment to the second compartment, the first planar surface facing the first compartment and the second planar surface facing the second compartment, the liquid aerosol-forming substrate being able to reach the fluid permeable aerosol-generating element only through the second compartment.

8. The cartridge of claim 7, wherein the connector and the first planar surface of the fluid permeable aerosol-generating element defines at least part of the air flow passage.

9. The cartridge of claim 7, wherein the first compartment is positioned between the fluid permeable aerosol-generating element and the mouth end opening.

10. The cartridge of claim 7, wherein the connector is connected to the first compartment and/or the second compartment by an interference fit.

11. The cartridge of claim 1, wherein the fluid permeable aerosol-generating element is a heater element.

12. The cartridge of claim 11 further comprising:

a heater assembly, the heater assembly including the heater element and electrical contact portions electrically connected to the heater element, the electrical contact portions being exposed through a connection end of the cartridge.

13. The cartridge of claim 12, wherein the storage compartment includes a heater mount, the heater mount being moulded over the heater assembly.

14. The cartridge of claim 1, wherein the first planar surface faces the first compartment.

15. An aerosol-generating system comprising:

the cartridge of claim 1 and a control body connected to the cartridge, the control body configured to control a supply of electrical power to the fluid permeable aerosol-generating element.

16. A cartridge for an aerosol-generating system, comprising:

a housing having a mouth end opening and an air inlet;

a storage compartment within the housing, the storage compartment configured to contain a liquid aerosol-forming substrate, the storage compartment having a first compartment and a second compartment connected by a connector, the first compartment being in communication with the second compartment via at least one liquid channel being defined within the connector;

an air flow passage extending from the air inlet to the mouth end opening, the air flow passage passing between the first compartment and the second compartment; and a fluid permeable aerosol-generating element having a first planar surface and a second planar surface opposite to the first planar surface, the first planar surface of the fluid permeable aerosol-generating element facing the first compartment, the second planar surface facing the second compartment, the second planar surface in fluid communication with the second compartment so that liquid aerosol-forming substrate in the first compartment can reach the fluid permeable aerosol-generating element only through the second compartment, the first planar surface and the connector forming part of the air flow passage, the first planar surface being between the first compartment and the second compartment, the storage compartment and the at least one liquid channel being adapted to communicate the liquid aerosol-forming substrate from the first compartment to the second compartment in a first direction before reversing course and communicating the liquid aerosol-forming substrate within the second compartment towards the first planar surface in a second direction, the first direction being opposite to the second direction, wherein the liquid aerosol-forming substrate in the first compartment reaches the fluid permeable aerosol-generating element only through the connector and the second compartment.

17. The cartridge of claim 16, wherein the first planar surface faces the first compartment.

18. An aerosol-generating system comprising:

a housing having a mouth end opening and an air inlet;

a storage compartment within the housing, the storage compartment configured to contain a liquid aerosol-forming substrate, the storage compartment including a first compartment in fluid communication with a second compartment, the first compartment being in communication with the second compartment via at least one liquid channel defined within the aerosol-generating system;

an air flow passage extending from the air inlet to the mouth end opening;

a fluid permeable aerosol-generating element within the housing and having a first planar surface and a second planar surface opposing the first planar surface, the second planar surface being in fluid communication with the second compartment, the first planar surface defining at least part of the air flow passage, the first planar surface being between the first compartment and the second compartment, the storage compartment and the at least one liquid channel being adapted to communicate the liquid aerosol-forming substrate from the first compartment to the second compartment in a first direction before reversing course and communicating the liquid aerosol-forming substrate within the second compartment towards the first planar surface in a second direction, the first direction being opposite to the second direction;

a removable seal having a seal portion and a tab portion in connection with the seal portion, the seal portion in the air flow passage over the first planar surface of the fluid permeable aerosol-generating element, the tab portion extending outwardly from the housing through the air inlet; and a control body configured to control a supply of electrical power to the fluid permeable aerosol-generating element.

19. The aerosol-generating system of claim 18, wherein the first planar surface faces the first compartment.

* * * * *